US009719755B2

(12) United States Patent
Klotz

(10) Patent No.: US 9,719,755 B2
(45) Date of Patent: Aug. 1, 2017

(54) ADAPTER PIECE AND HANDHELD FIREARM COMPRISING SUCH AN ADAPTER PIECE

(71) Applicant: L&O Hunting Group GmbH, Isny (DE)

(72) Inventor: Matthias Klotz, Gestratz (DE)

(73) Assignee: L&O HUNTING GROUP GMBH, Isny (DE)

( * ) Notice: Subject to any disclaimer, the term of this patent is extended or adjusted under 35 U.S.C. 154(b) by 0 days.

(21) Appl. No.: 15/178,773

(22) Filed: Jun. 10, 2016

(65) Prior Publication Data

US 2016/0363416 A1 Dec. 15, 2016

(30) Foreign Application Priority Data

Jun. 15, 2015 (DE) ..... 10 2015 109 488

(51) Int. Cl.

| | |
|---|---|
| ***F41A 15/00*** | (2006.01) |
| ***F41C 27/00*** | (2006.01) |
| ***F41G 11/00*** | (2006.01) |
| ***F41C 23/16*** | (2006.01) |

(52) U.S. Cl.

CPC ..... *F41C 27/00* (2013.01); *F41C 23/16* (2013.01); *F41G 11/003* (2013.01)

(58) Field of Classification Search

CPC .... F41G 11/003; F41G 11/004; F41G 11/001; F41G 11/002; F41G 11/005; F41G 1/387; F41C 23/16; F41C 23/04; F41A 23/16; F41A 21/325

USPC ..... 42/90, 94; 248/163.1; 89/40.06; 73/167

See application file for complete search history.

(56) References Cited

U.S. PATENT DOCUMENTS

| | | | |
|---|---|---|---|
| 8,393,108 | B1 | 3/2013 | Wilson |
| 2014/0157644 | A1 | 6/2014 | Jiminez et al. |
| 2015/0075054 | A1 | 3/2015 | Barger |

OTHER PUBLICATIONS

Result of examination report for German Patent Application No. 10 2015 109 488.6, filed Jun. 15, 2015.

*Primary Examiner* — Samir Abdosh

(74) *Attorney, Agent, or Firm* — Paul D. Bianco; Fleit Gibbons Gutman Bongini & Bianco PL

(57) ABSTRACT

An adapter piece for mounting weapon accessory parts on a handheld firearm having a main body which includes mounting elements for detachably attaching the weapon accessory parts. To ensure flexible and accurate mounting of the weapon accessory parts, a fastening element for detachably attaching the main body to a front stock of the handheld firearm is disposed on the main body.

16 Claims, 3 Drawing Sheets

ADAPTER PIECE AND HANDHELD FIREARM COMPRISING SUCH AN ADAPTER PIECE

FIELD OF THE INVENTION

An adapter piece for mounting weapon accessory parts on a handheld firearm and a handheld firearm with such an adapter piece are disclosed.

BACKGROUND

To mount accessory parts, e.g., bipods, lamps, sights, cameras and the like, quickly and repetitively accurately on handheld firearms, so-called Picatinny rails are often used. However, these generally standardized mounting rails or other suitable adapters are, as a rule, integrated into the weapon housing or stationarily attached on a front stock or on other parts of the weapon. As a result, these mounting devices are not very flexible and, in addition, cannot be easily mounted and dismounted.

SUMMARY OF THE DISCLOSURE

At least some embodiments of the disclosure relate to an easily mountable and dismountable adapter piece and a handheld firearm comprising such an adapter piece which allows accessory parts to be flexibly and accurately mounted.

Other useful embodiments and advanced embodiments are also disclosed.

On the adapter piece according to the present invention, a fastening element for detachably attaching the main body to a front stock of a handheld firearm is disposed on the main body which is fitted with mounting elements. As a result, when required, the adapter piece can be easily mounted and can be rapidly dismounted as well. To be able to mount accessory parts, the adapter piece offers a specially adapted front stock extension, thereby allowing any handheld firearm thus equipped to be modularly adjusted to the given needs without great effort.

In an especially preferred embodiment of the invention, the fastening element comprises a fastening pin which can be inserted into an opening of the front stock.

A ball ratchet mechanism with spring-loaded ratchet balls for the ratchet mounting of the adapter piece on the front stock can be conveniently disposed on the fastening element. The ratchet balls which are preferably evenly distributed along the circumferential direction are advantageously disposed in the fastening pin. This type of ball ratchet mechanism ensures not only quick and simple mounting and dismounting, but also enables accurate positioning and protects the adapter piece from being inadvertently pulled out and twisted.

Versatile mounting on the main body can be achieved, e.g., by configuring the mounting elements in the form of Picatinny rails which are disposed on the lower surface and the two outside surfaces of the main body which has a U-shaped cross section. The mounting elements can also be Weaver rails or other similar fastening bases that are suitable to receive accessory parts.

To expand the range of applications of the adapter, a roof-shaped upper part with an additional Picatinny rail or other mounting elements can be disposed on the main body.

The upper part is preferably removably attached to the main body. To this end, on the outside surfaces of two downwardly projecting legs, the upper part can comprise guide rails, which extend in the longitudinal direction relative to the upper part and which are spaced apart by a recess, for reaching under rib-like guide members on the inside surfaces of two upwardly projecting rib-like members of the main body. Because of the removable attachment of the upper part, it is possible to attach the upper part after the main body has been mounted on the front stock. This allows the adapter part to be mounted on handheld firearms which have, e.g., an open sight (rear and front sight) or a silencer with a larger diameter, without requiring a size adjustment. In contrast, on an adapter piece with a fixedly mounted upper part, the passage opening would need to be appropriately adjusted, which requires a corresponding size. Because of the removable upper part, the adapter piece can instead be manufactured in a slender design for a large variety of weapons.

To affix the upper part precisely positioned and securely to the main body, a ball ratcheting mechanism with, e.g., pressure pins for engaging in depressions of the upper part can be disposed in the main body. The pressure pins are preferably disposed in the main body in such a manner that in the mounted position of the upper part, the center line of said pressure pins is staggered in the direction of the stop surfaces in the main body with respect to the center line of the depressions of the upper part which are configured in the form of tapered bores. As a result, the upper part is continually pressed upwardly and forwardly against the stop surfaces of the main body so that the upper part can be positioned repetitively accurately on the main body.

On its end lying opposite to the fastening pin, the fastening element can have a receiving part for a sling mount. The receiving part can be configured in such a manner that as said receiving part is activated, the ratchet balls disposed on the fastening pin are moved into a disengaged position, thereby making it possible for the ratchet mechanism to be disengaged.

The fastening element can be detachably attached to the main body. However, it can also be integrally formed in one piece with the main body.

The present invention also relates to a gun or another suitable handheld firearm fitted with such an adapter piece.

BRIEF DESCRIPTION OF THE DRAWINGS

Additional features and advantages of the present invention follow from the description of a preferred practical example below based on the drawings. As can be seen

DETAILED DESCRIPTION

Figure 1:
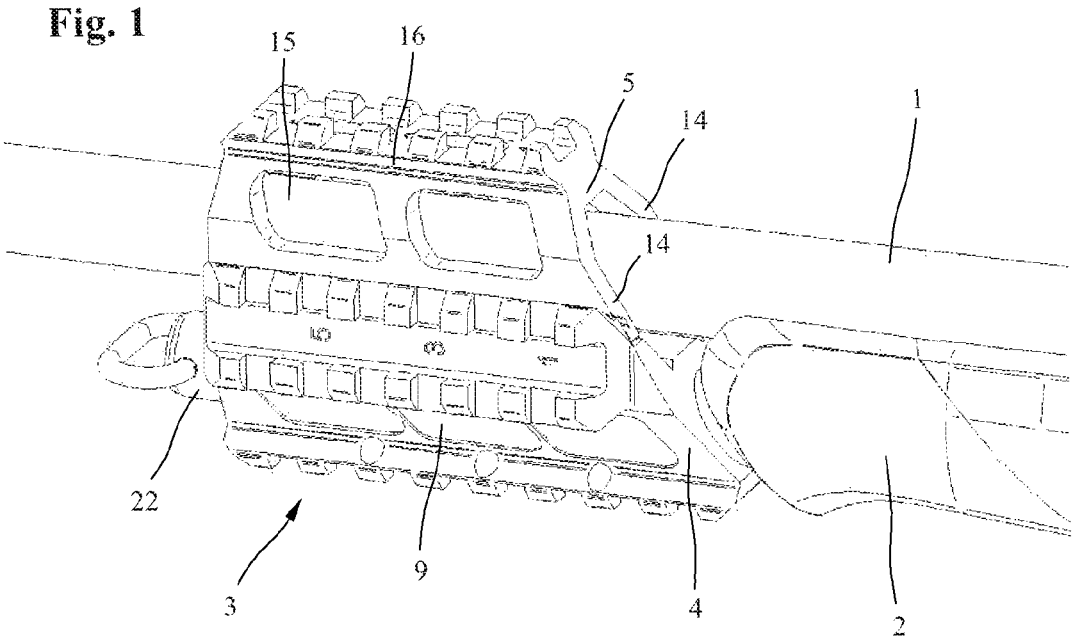
FIG. 1 shows a perspective view of a portion of a gun with an adapter piece according to the present invention.

FIG. 1 shows part of a handheld firearm in the form of a gun, comprising a barrel 1, a front stock 2 and an adapter piece 3, which is detachably mounted on the front stock 2, for mounting bipods, lamps, sights, cameras or other weapon accessory parts. The adapter piece 3 comprises a main body 4 and an upper part 5 which is detachably attached to main body. The upper part 5 has a cross section in the shape of an upside down U and is configured in such a manner that it straddles the barrel 1 on the upper surface.

Figure 2:
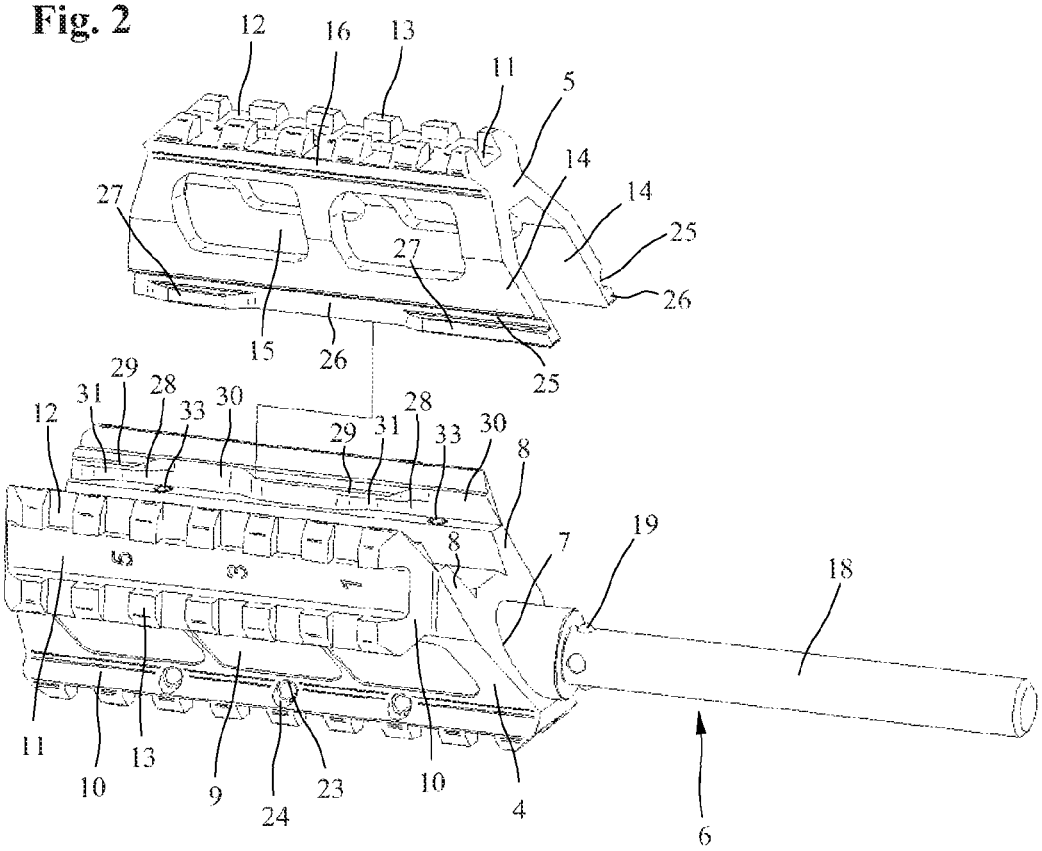
FIG. 2 shows the adapter piece of FIG. 1 with a main body and an upper part in a dismounted state.

As FIG. 2 indicates, a fastening element 6 here configured as a fastening pin for detachably attaching the main body 4 to the front stock 2 is disposed on the main body 4. The main body 4 can be attached to the front stock 2 by means of the fastening element 6 which can be inserted into a corresponding opening on the front surface of the front stock 2. The main body 4 comprises a passage opening 7 for the fastening element 6, which is shown separately in FIG. 3, as well as two upwardly projecting parallel rib-like members 8. For weight reduction, lateral cutouts 9 can be provided in the main body 4. On the lower surface and the two outside surfaces of the main body 4 which has a U-shaped cross section, mounting elements 10, here configured in the form of Picatinny rails, are disposed. The mounting elements 10 which are configured in the form of Picatinny rails comprise a longitudinal groove 11 as known in the art as well as rectangular transverse grooves 12 spaced at regular intervals from each other so as to form tooth-like elevations 13. However, the mounting elements 10 can also be configured in a different way so as to form a suitable interface for allowing an easy and precisely positioned attachment of accessory parts.

The roof-shaped upper part 5 is configured with two downwardly projecting legs 14. For weight reduction, the upper part 5 has lateral cutouts 15 as well. On its upper surface, the upper part comprises an upper mounting element 16 again configured in the form of a Picatinny rail 16 and having a longitudinal groove 11 and rectangular transverse grooves 12 spaced at regular intervals from each other so as to form tooth-like elevations 13.

Figure 3:
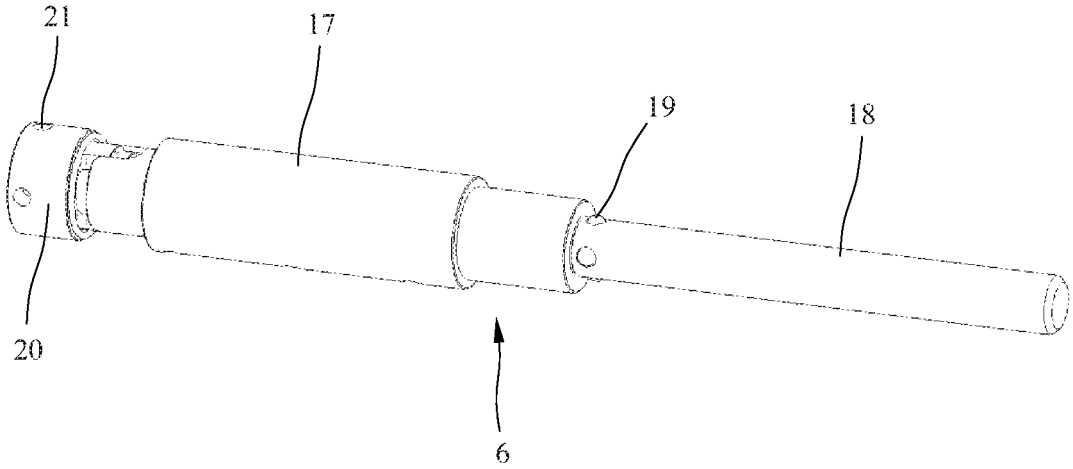
FIG. 3 shows a mounting element of the adapter piece shown in FIG. 2.

The fastening element 6, which is shown separately in FIG. 3, comprises a cylindrical clamping area 17 which is disposed inside the main body 4 and a fastening pin 18 which projects with respect to the main body 4. In the fastening pin 18, four ratchet balls 19, which are evenly distributed along the circumference, are disposed for the ratchet mounting of the fastening element 6 in a corresponding opening of the front stock 2. On its end lying opposite to the fastening pin 18, the fastening element 6 comprises an axially movable receiving part 20 with radial bores 21 to allow for the ratchet fixation of a sling mount 22 shown in FIG. 1.

The sling mount 22 can be part of an Allen key which can be inserted into an opening on the receiving part 20 of the pin-shaped fastening element 6 and detachably attached to the fastening element 6 by means of spring-loaded ratchet balls which engage in the bores 21. The sling mount 22 can also be inserted into the opening of the front stock 2 when the adapter piece 3 is being dismounted. The ball ratchet mechanism of the ratchet balls 19 can be released by means of the receiving part 20 which can be axially moved relative to the clamping area 17, thereby making it possible for the main body 4 to be removed from the front stock 2. In this manner, the sling mount 22 which is inserted in the receiving part 20 can serve as a release button for the ball ratchet mechanism of the pin-shaped fastening element 6. The fastening element 6 can be mounted in the main body 4 by means of spring clamping bolts 23 (seen in FIG. 2 and FIG. 5) or studs which are disposed in corresponding transverse bores 24 in the main body 4.

Figure 4:
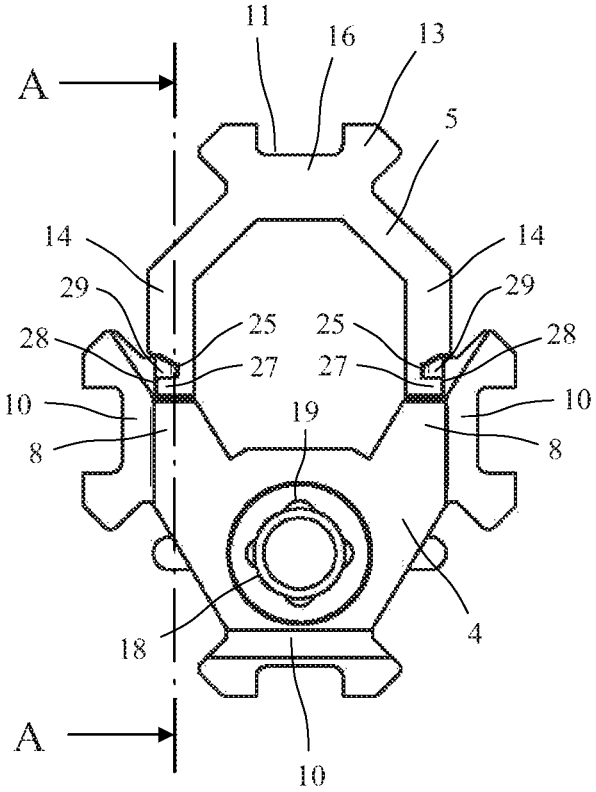
FIG. 4 shows a front view of the adapter piece of FIG. 1.
Figure 5:
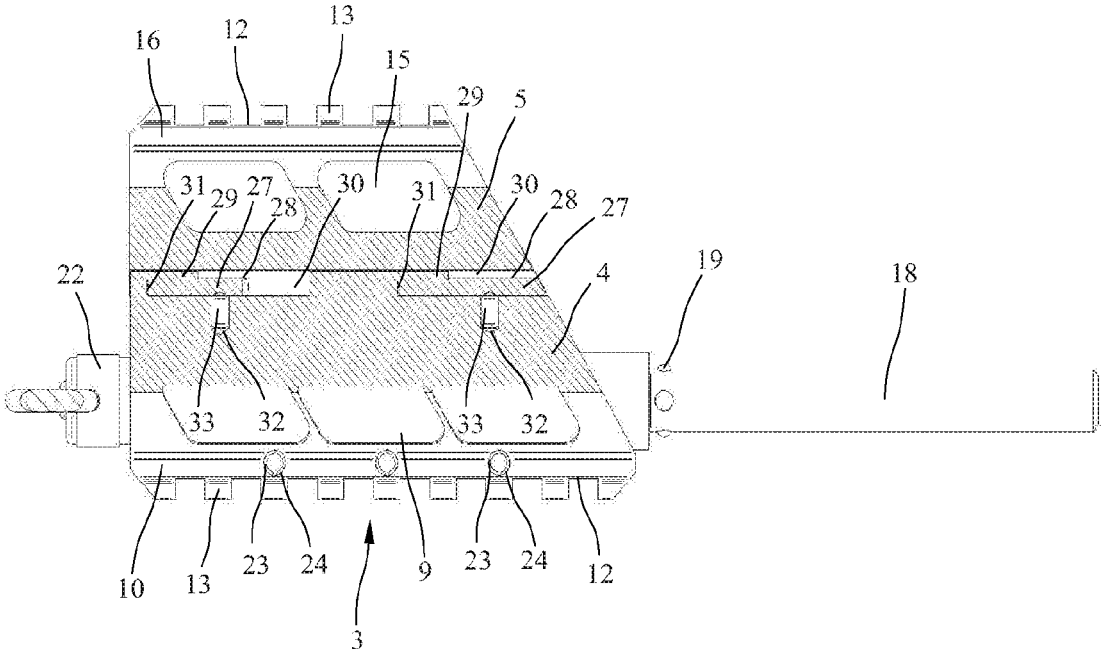
FIG. 5 shows a sectional view along the line A-A of FIG. 4.

As FIGS. 2, 4 and 5 indicate, the roof-shaped upper part 5 can be placed onto the main body 4 and be held in place by pushing it forwardly and downwardly. To this end, on the outside surfaces of the two downwardly projecting legs 14, the upper part 5 comprises two guide grooves 25 extending in the longitudinal direction relative to the upper part 5 and two guide rails 27 spaced apart by a recess 26, said guide grooves and guide rails being configured for engaging in receiving grooves 28 and for reaching under rib-like guide members 29 on the inside surfaces of the two upwardly projecting parallel rib-like members 8 of the main body 4. The receiving grooves 28 are upwardly bounded by the rib-like guide members 29. The rib-like guide members 29 on the main body 4 are interrupted by front and rear recesses 30 for insertion of the guide rails 27 on the upper part 5. The receiving grooves 28 have front stop surfaces 31 for bounding the guide rails 27.

Figure 6:
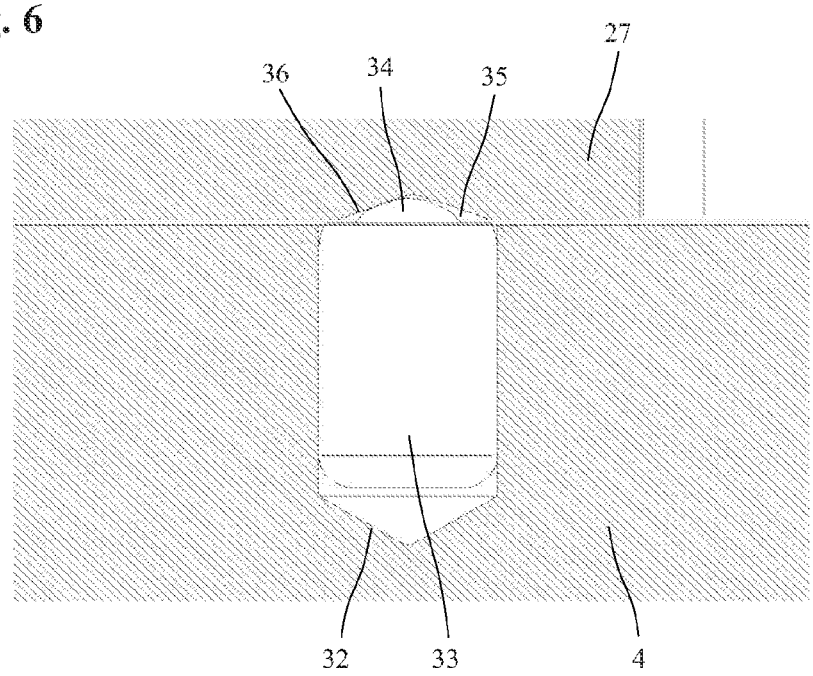
FIG. 6 shows a detail view of a ball ratchet mechanism between a main body and an upper part of the adapter piece.

To affix the upper part 5 to the main body 4, the main body 4 comprises a ball ratchet mechanism shown in greater detail in FIGS. 5 and 6 and having two pressure pins 33 each, which pressure pins are disposed in bores 32 on the two receiving grooves 28 engaging in depressions 35 of the upper part 5. The pressure pins 33 are disposed in such a manner that in the mounted position of the upper part 5, said pressure pins push from below against the guide rails 27 and press the upper surface of said guide rails against the lower surface of the rib-like guide members 29. To this end, a spring-loaded ratchet ball 34 can be provided on the pressure pins 33 for engaging in the depression 35 disposed on the lower surface of the rib-like guide members 29.

As FIG. 6 indicates, the pressure pins 33 and the bores 32 are disposed in the main body 4 in such a manner that in the mounted position of the upper part 5, their center line is staggered in the direction of the stop surfaces 31 shown in FIG. 5 with respect to the center line of the depression 35 which is configured, e.g., in the form of a tapered bore. This causes the ratchet ball 34 to be pushed against a tapered surface 36 of the depression 35 which is configured in the form of a tapered bore, which tapered surface faces the stop surfaces 31, and the upper part 5 is continually pressed upwardly and forwardly against the stop surfaces 31 of the main body 4. In this manner, it is possible to ensure repetitively accurate positioning of the upper part 5 on the main body 4.

What is claimed is:

1. An adapter piece for mounting weapon accessory parts on a handheld firearm, the adaptor piece comprising a main body which includes mounting elements for detachably attaching the weapon accessory parts, wherein a fastening element for detachably attaching the main body to a front stock of the handheld firearm is disposed on the main body, and wherein a ball ratchet mechanism with spring-loaded ratchet balls for ratchet mounting of the adapter piece on the front stock is disposed on the fastening element.

2. The adapter piece of claim 1, wherein the fastening element comprises a fastening pin which can be inserted into an opening of the front stock.

3. The adapter piece of claim 1, wherein the mounting elements are configured in the form of Picatinny rails, Weaver rails or other suitable profiles for attaching the weapon accessory parts.

4. The adapter piece of claim 1, wherein the mounting elements are disposed on a lower surface and two outside surfaces of the main body, which has a U-shaped cross section.

5. The adapter piece of claim 1, wherein a roof-shaped upper part is disposed on the main body.

6. The adapter piece of claim 5, wherein at least one additional mounting element is disposed on the roof-shaped upper part.

7. The adapter piece of claim 5, wherein the upper part is detachably attached to the main body.

8. The adapter piece of claim 5, wherein on outside surfaces of two downwardly projecting legs, the upper part comprises guide rails, which extend in a longitudinal direction relative to the upper part and which are spaced apart by a recess, for reaching under rib-like guide members on inside surfaces of two upwardly projecting rib-like members of the main body.

9. The adapter piece of claim 5, wherein the upper part is mounted on the main body by a ball ratcheting mechanism.

10. The adapter piece of claim 9, wherein the ball ratcheting mechanism comprises pressure pins for engaging in depressions of the upper part.

11. An adapter piece for mounting weapon accessory parts on a handheld firearm, the adaptor piece comprising a main body which includes mounting elements for detachably attaching the weapon accessory parts, wherein a fastening element for detachably attaching the main body to a front stock of the handheld firearm is disposed on the main body; wherein a roof-shaped upper part is disposed on the main body; wherein the upper part is mounted on the main body by a ball ratcheting mechanism, the ball ratcheting mechanism comprising pressure pins for engaging in depressions of the upper part; and wherein the pressure pins are disposed in the main body such that in the mounted position of the upper part, the center line of said pressure pins is staggered in the direction of the stop surfaces in the main body with respect to the center line of the depressions in the upper part which are configured in the form of tapered bores.

12. The adapter piece of claim 2, wherein on an end of the adapter piece lying opposite to the fastening pin, the fastening element has a receiving part for a sling mount.

13. The adapter piece of claim 12, wherein the ratchet balls of the ball ratchet mechanism are disposed on the fastening pin, and wherein the receiving part is configured such that the ratchet balls are moved into a disengaged position upon activation of the receiving part.

14. The adapter piece of claim 1, wherein the fastening element is detachably attached to the main body.

15. A handheld firearm comprising a barrel, a front stock and the adapter piece of claim 1 disposed on the front stock.

16. The adapter piece of claim 10, wherein the pressure pins are disposed in the main body such that in the mounted position of the upper part, the center line of said pressure pins is staggered in the direction of the stop surfaces in the main body with respect to the center line of the depressions in the upper part which are configured in the form of tapered bores.

* * * * *